US006186238B1

(12) United States Patent
Tornquist

(10) Patent No.: US 6,186,238 B1
(45) Date of Patent: Feb. 13, 2001

(54) ASSEMBLY AND METHOD FOR THE EXTRACTION OF FLUIDS FROM A DRILLED WELL WITHIN A GEOLOGICAL FORMATION

(75) Inventor: Fernando Maria Solanet Tornquist, Buenos Aires (AR)

(73) Assignee: YPF S.A. (AR)

( * ) Notice: Under 35 U.S.C. 154(b), the term of this patent shall be extended for 0 days.

(21) Appl. No.: 09/376,638

(22) Filed: Aug. 18, 1999

(51) Int. Cl.[7] ..... E21B 43/12
(52) U.S. Cl. ..... 166/369; 166/105.2
(58) Field of Search ..... 166/369, 370, 166/383, 66.6, 66.7, 68, 69, 105, 105.2, 105.4; 417/378, 402, 404

(56) References Cited

U.S. PATENT DOCUMENTS

| | | | | |
|---|---|---|---|---|
| 3,304,871 | * | 2/1967 | Scroggins | 417/402 |
| 3,653,786 | * | 4/1972 | McArthur et al. | 417/404 |
| 3,703,926 | * | 11/1972 | Roeder | 166/106 |
| 4,360,288 | | 11/1982 | Rutledge, Jr. et al. . | |
| 4,476,923 | | 10/1984 | Walling . | |
| 4,592,421 | | 6/1986 | Hoffmann et al. . | |
| 4,778,355 | * | 10/1988 | Holland | 417/378 |
| 4,863,091 | | 9/1989 | Dubois . | |
| 5,667,369 | | 9/1997 | Cholet . | |
| 5,915,475 | * | 6/1999 | Wells et al. | 166/68.5 |

* cited by examiner

*Primary Examiner*—Frank Tsay
(74) *Attorney, Agent, or Firm*—Akin, Gump, Strauss, Hauer & Feld

(57) ABSTRACT

The present invention includes an assembly and method to pump fluids produced by a drilled well within a geological formation having a borehole wall fixed by casing. The invention includes a subsurface pump having a stationary member and a mobile member. A pump anchor fixes the pump to the well casing. A hollow continuous tube or coiled tubing extends within the well bore from the surface down to the lower portion of the well bore. The bottom end of the coiled tubing is connected to the mobile member of the pump. Preferably, the coiled tubing can be coiled and uncoiled from a reel located on the surface. A hollow polished rod has a bottom end coupled to a free top end of the coiled tubing. The hollow polished rod is connected to means to operate the hollow rod according to a selected movement, preferably reciprocating axial movement. The pumped fluids are recovered on the surface from the hollow polished rod and coiled tubing.

21 Claims, 3 Drawing Sheets

ASSEMBLY AND METHOD FOR THE EXTRACTION OF FLUIDS FROM A DRILLED WELL WITHIN A GEOLOGICAL FORMATION

CROSS-REFERENCE TO RELATED APPLICATIONS

This application claims priority from Argentinian Patent Application No. 98 01 04089, filed Aug. 19, 1998.

STATEMENT REGARDING FEDERALLY SPONSORED RESEARCH

Not applicable.

BACKGROUND OF THE INVENTION

1. Field of the Invention

The present invention pertains to an apparatus and method to extract through pumping, an effluent produced by a drilled well within a geological formation. Preferably, it pertains to the extraction of hydrocarbons. Specifically, the assembly and method comprises the use of continuous coiled tubing capable of transporting effluents to the surface through its interior.

2. Description of the Related Art

Although the demand for liquid hydrocarbons and gas increases, crude oil prices are declining. The reduced prices bring about the need to develop new techniques and methods of artificial lift, and new devices or equipment that reduce the initial investment on a new well, and reduce the lifting cost in new, or even old wells.

Typically, a well is drilled once an underground oil and gas formation or formations are detected. The typical diameter of the drilled hole is about 12¼" in the first 300 feet of borehole, and about 8½" to total depth or T.D.

Once the borehole is drilled to total depth, the borehole is cased from the surface to the bottom with either 5½" or 7" steel pipe or casing. The casing is cemented in place by displacing cement through the annular space between the external wall of the casing and the wall of the borehole. Cementing the casing provides firm anchorage of the casing to the borehole and seals the annular space along the entire length of the borehole with the displaced volume of cement.

After the casing has been cemented, the casing is perforated. The perforations are made in the casing at selected elevations or locations according to the nature of the reservoir or reservoirs. The perforations are holes that extend through both the casing wall and the cement sheath in the annular space and allow the free flow of production fluids to the well bore.

In some regions, the pressure of the reservoir, via natural gas, is sufficient to allow the natural lift of the produced fluids to the surface. Such wells are typically identified as "flowing wells." However, reservoirs are, in general, of low pressure, making necessary the use of artificial lift techniques to convey fluids from the well to the surface.

A conventional artificial lift technique comprises a subsurface pump, also called a "rod pump," placed at the bottom of the well. The rod pump is mechanically activated by a string of rods known as "sucker rods" connected on the surface to a walking beam pumping unit. The rod pump and string of sucker rods are deployed or run inside a string of production tubing within the casing. The pumped fluids are conveyed to the surface through the annular space defined by the bore of the production tubing and the string of sucker rods. In conventional wells such as the one described, the production tubing is either 2⅞" or 3½" outside diameter ("OD") and the length of the production tubing string extends from the surface or wellhead to near the bottom of the well.

Among other limitations stated below, sucker rods are subjected to wear due to frictional contact with the wall of the production tubing. The sucker rod wear increases in deviated, slant or crooked holes. Sucker rods in general are subject to mechanical failures either on the rod itself or in the threaded connections joining the individual sections of sucker rods. The various sucker rod failures can result in frequent replacement of the sucker rods. Occasionally, the subsurface pump which needs to be retrieved to the surface for repair. Additionally, the production tubing also requires, from time to time, to be replaced due to mechanical wear or leaking connections.

In the above cases where there has been a failure in the sucker rod string, the subsurface pump, or the production tubing, it is typically necessary to move a rig, commonly referred to as a workover rig or pulling unit, onto the well to pull out of the hole the worn or damaged items for replacement or repair. Typically, workover rigs or pulling units include a derrick provided with working pulleys, a cable drum and drawworks to allow running in or pulling out of the hole the pipe or rods. To keep the cost of service as low as possible, rig up and rig down procedures, as well as going in and out of the hole, needs to be done efficiently and economically. Operations efficiency will also depend on the costs involved to move such rig or rigs from well location to well location, as well as the time involved in making or breaking tubing or sucker rod connections.

Various patents have attempted to reduce the costs involved in well operations. Patent AR 230316 discloses a sucker rod made of fiberglass, whose weight is considerably less, thus requiring less energy for its operation. Patent AR 234862 also discloses the replacement of steel sucker rods by fiberglass rods.

U.S. Pat. No. 5,667,369 to Cholet discloses the replacement of sucker rods with continuous coiled tubing to move the rotor of a progressive cavity pump ("PCP pump") by connecting the bottom end of the continuous coiled tubing to the rotor of the PCP pump. In this case, the rotor of the PCP pump turns by rotating the coiled tubing from the surface. Continuous tubing or coiled tubing weighs less and is easier to handle than sucker rods, although the use of a production tubing string is still necessary in Cholet.

U.S. Pat. No. 4,476,923 to Walling describes a coiled, composite tubing that allows the effluents to be conducted through its interior. The coiled, composite tubing supports an electric activated downhole pump. Electricity is conveyed from the surface to the downhole electric motor through conductors that extend along and through sheaths of the composite tubing. Thus, the composite tubing comprises a complex succession of sheaths wrapped in different materials able to provide the required strength to the composite tubing.

It is desirable to have an assembly and method to pump an effluent produced by a drilled well in a geological formation without the use of typical production tubing and sucker rods. It is further desirable to provide a lighter production string that can be run in the hole and easily retrieved without the need of a derrick, substructure and drawworks.

SUMMARY OF THE INVENTION

The present invention provides an assembly and method to pump an effluent produced by a drilled well in a geological formation without the use of typical production tubing and sucker rods.

The assembly and method of the present invention includes a continuous tube or coiled tubing connected to a subsurface pump. The continuous tube serves dual purposes. The continuous tube serves as a reciprocating pumping string and also as a conduit to raise and convey, simultaneously, effluents from the bottom of the hole to the surface. The continuous tube serves as the production string and eliminates the conventional production string. The coiled tubing production string is lighter in weight than a conventional production string. The coiled tubing production string can be run in the hole and easily retrieved by coiling it around a reel or drum, without the need of a derrick, substructure and drawworks. The reel or drum can be mounted on a trailer and easily transported from well to well.

The present invention is cost effective in that it provides an assembly and method to produce hydrocarbons from a well by replacing sucker rods, production tubing and their corresponding couplings. This allows for the reduction of cost, both in steel, as well as in operating procedures such as making and breaking connections.

The assembly and method of the present invention also allows the evident advantages due to the possibility to drill and produce from wells with smaller internal diameters than conventional wells. The present invention allows drilling with small diameter drill bits and casing the hole with small diameter pipe, thus involving less drilling costs, expendables and materials.

The present invention also provides an assembly and method of pumping from slanted or crooked holes. The present invention is adapted for producing from a low volume producer oil well.

The present invention includes an assembly to pump fluids produced by a drilled well within a geological formation having a borehole wall fixed by casing. The assembly includes a subsurface pump, commonly referred to as a rod pump. The subsurface pump includes one steady or stationary barrel member and one mobile plunger member. A retrievable pump anchor fixes the rod pump to the casing of the well at a determined depth. A hollow continuous tube, commonly described as coiled tubing, extends within the well bore from the surface down to the lower portion of the well bore. The bottom end of the continuous tube is connected to the mobile plunger member of the rod pump. The connection between the continuous tube and the mobile plunger member is of a single direct path type allowing fluid flow from within the pump body to the hollow continuous tube. Preferably, the continuous tube is coiled tubing that can be coiled and uncoiled from a reel located on the surface. A hollow polished rod has a bottom end coupled to a free top end of the continuous hollow tubing. The hollow polished rod is connected to means to operate the continuous hollow rod according to a selected movement, preferably reciprocating axial movement. The pumped fluids are recovered on the surface from the hollow polished rod and continuous tube.

The present invention also comprises a method for pumping fluids produced by a drilled well within a geological formation having a borehole wall secured by a steel casing which is perforated at selected levels. The method comprises the steps of connecting a retrievable pump anchor to a stationary barrel member of a subsurface pump. A mobile plunger member of the subsurface pump is connected to a free bottom end of a continuous hollow tube. The connection is of the type that communicates the inside of the plunger member and pump barrel with the inside of the continuous hollow tube. The continuous hollow tube is uncoiled and run into the cased borehole until reaching a predetermined depth. The continuous hollow tube is cut on the surface. Anchoring devices of the retrievable pump anchor are set to secure the pump anchor to the well casing. The bottom end of a hollow polished rod is connected to the top end of the continuous hollow tube. At least one packing element is installed in the surface casing or wellhead to seal the annulus between the casing and the hollow polished rod. The hollow polished rod is operated according to a selected reciprocating axial movement to recover the fluid that ascends through the bore of the continuous hollow tube. The recovered production fluid is sent to a production manifold through a flexible hose.

BRIEF DESCRIPTION OF THE DRAWINGS

In order to more fully understand the drawings referred to in the detailed description of the present invention, a brief description of each drawing is presented, in which.

DETAILED DESCRIPTION OF INVENTION

Figure 1:
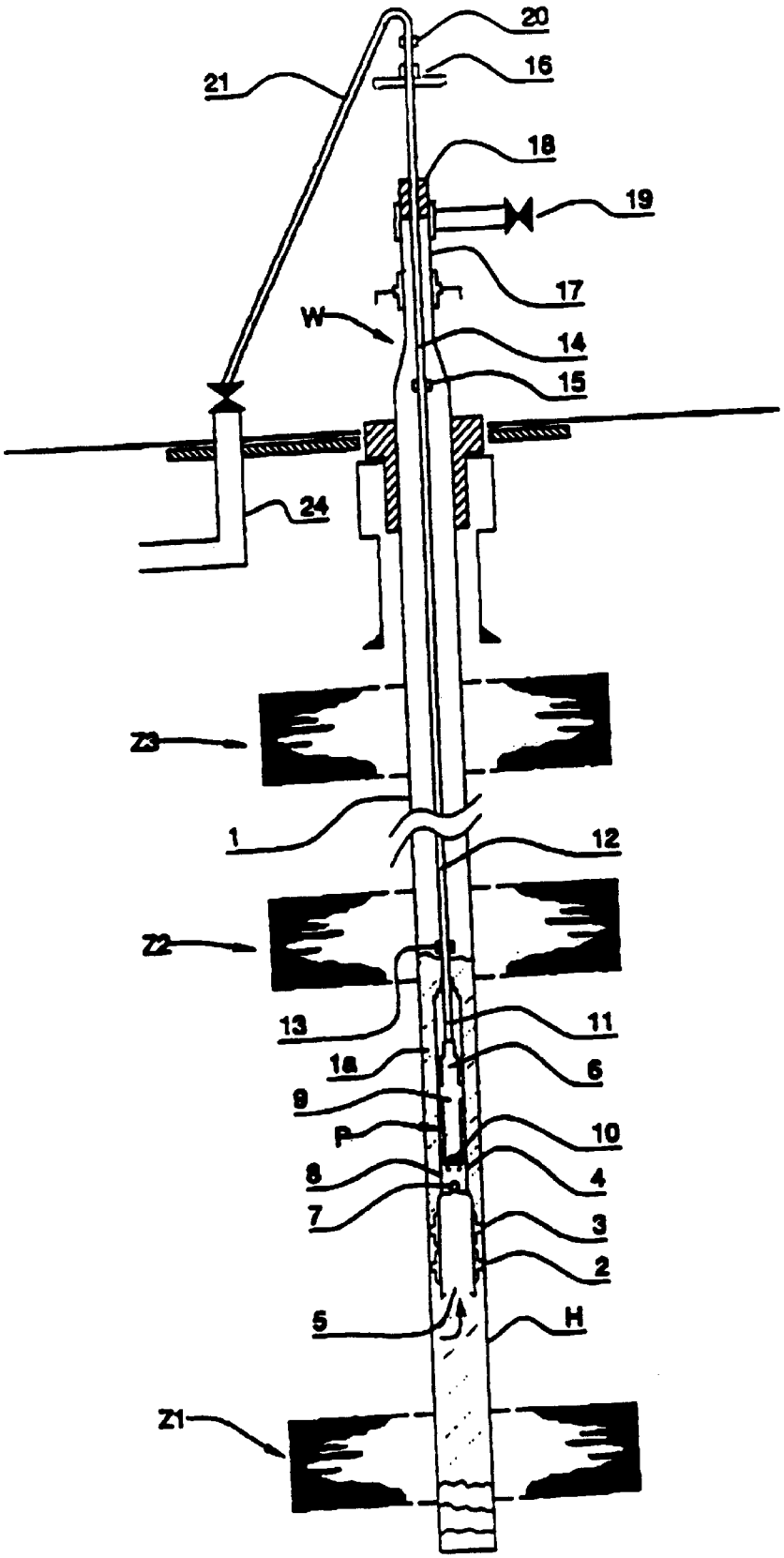
FIG. 1 is a simplified diagram of an assembly according to the present invention having a subsurface pump or rod pump.

The present invention will now be described in greater detail with specific reference to the drawings. FIG. 1 shows a well made in a geological formation that produces hydrocarbon-containing effluents. The well borehole H is covered by a casing or pipe 1. Preferably, the casing 1 is fixed or anchored to the borehole H with cement (not shown) injected in the annular space (not shown) existing between the external surface of the casing 1 and the borehole H. As discussed in the background of the invention, the cement and casing is perforated in areas at selected depths and locations so as to allow the free flow of fluids from the reservoir or reservoirs into the well casing 1. FIG. 1 illustrates three pay zones Z1, Z2, and Z3 at different depths. This is just an example of "multilayer" formations in a well.

Referring to FIG. 1, the illustrated pumping apparatus P includes a subsurface pump 4 having a retrievable pump anchor 2 connected through an adapter to a lower portion of the subsurface pump 4. The subsurface pump 4 illustrated in FIG. 1 is of a reciprocating or alternative movement type, and includes a standing valve 7, a steady or stationary barrel member 8, a mobile plunger member 9 which lodges a second or traveling valve 10, and a hollow pull rod 11. A suitable pump for the exemplified device is the "hollow rod type" pump available from Harbison-Fisher.

The retrievable pump anchor 2 includes one or more anchoring devices 3 having sets of slips which enable the setting of the pump anchor 2 of the pumping apparatus P to the well casing 1. The anchoring devices 3 of the retrievable pump anchor 2 are set inside the casing 1 at a location near the bottom of the well. An opening 5 at the bottom end of the retrievable pump anchor 2 allows the flow of fluids to the suction chamber of the subsurface pump 4, as indicated by the arrow in FIG. 1.

It is to be understood that the anchoring devices 3 are of the type that will allow the free flow of fluids from the annular space 1*a* between the outer wall surface of the stationary barrel member 8 of the subsurface pump 4 and the inner wall surface of the well casing 1 to the opening 5. Stated another way, the anchoring devices 3 allow the free flow of fluids from above to below the anchoring devices 3, or vice versa. A useful anchor for this type of service is the 2⅞" or 3½" retrievable pump anchor provided by Harbison-Fisher or similar, without the packing element.

Referring to FIG. 1, the mobile plunger member 9 includes the traveling valve 10 at its lower end and the hollow pull rod 11 connected at its upper end. Pumped fluid travels upwardly through the inside 6 of the mobile plunger member 6 of the subsurface pump 4. The upper end of the hollow pull rod 11 of the pump plunger member 6 is connected to a continuous hollow tube 12, preferably coiled tubing. The connection 13 is preferably the type of "roll on" connector with the addition of an outer liner to avoid further deformation. Furthermore, the connector allows the free flow of fluids from the inside 6 of the pump bore to the bore of the continuous hollow tube or coiled tubing 12.

The continuous hollow tube or coiled tubing 12 extends toward the upper part of the well or the wellhead W at the surface, typically the ground surface. The upper end of the coiled tubing 12 is coupled to a hollow rod 14, typically a hollow polished rod, by an appropriate connector 15. The hollow polished rod 14 has a bore which allows the flow of fluids. The hollow polished rod 14 is suspended through a crosshead 16 so as to be operated by a "pumping unit" (not shown) that imparts an alternative or reciprocating axial movement to the hollow polished rod 14, the coiled tubing 12, the hollow pull rod 11 and the mobile plunger member 9.

Figure 2:
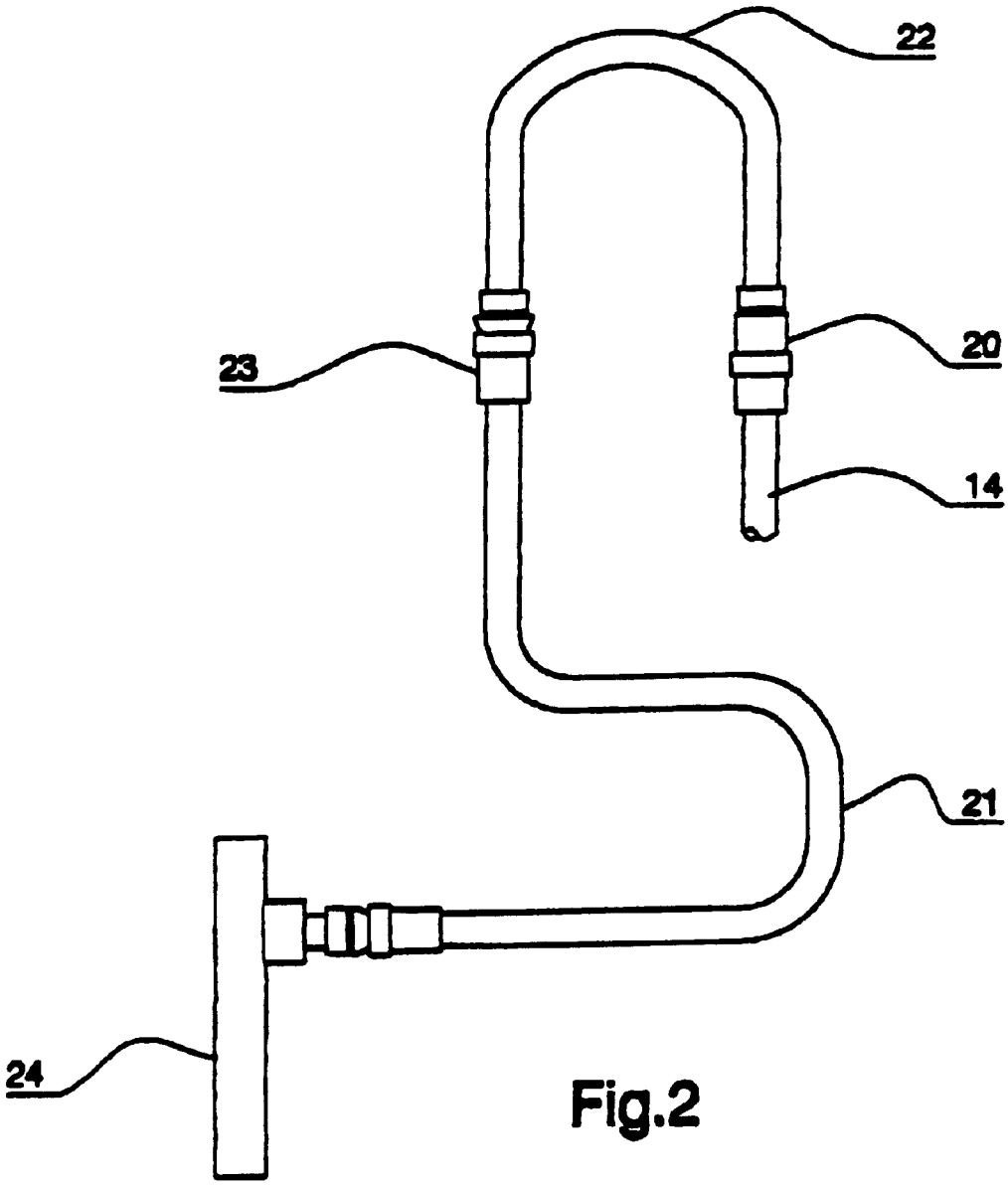
FIG. 2 is a detail of the hollow, polished rod and flexible hose arrangement of the fluid recovery means on the surface.

As shown in FIGS. 1 and 2, the upper end of the hollow polished rod 14 is coupled with an appropriate coupler 20, preferably a "quick hydraulic connector," to a flexible hose 21. The flexible hose 21 conveys the produced fluids to a production manifold 24 and follows the movement of the hollow polished rod 14 in its reciprocating up and down motion.

At the wellhead W, the casing 1 is extended and connected to a reduction member 17. The reduction member 17 is provided with packing elements 18 around the hollow polished rod 14.

Referring to FIG. 1, the hydrocarbon fluids, gases, etc. that may spontaneously flow through the annulus between the continuous hollow tube or coiled tubing 12 and the well casing 1 are released through a lateral port 19 provided with valves. Typically, gas from hydrocarbons is released due to a reduction in bottom hole pressure. In other instances, the well may accumulate sufficient internal energy such that gas or oil will flow freely. In these cases, the fluids or gas are released through the port 19.

FIG. 2 shows the preferred assembly of the hollow polished rod 14 and the flexible hose 21 in greater detail. Preferably, the hollow polished rod 14 is connected to the flexible hose 21 through the quick hydraulic connector 20, an inverted "U" shaped tubing 22, and a second coupler 23, preferably a quick hydraulic connector. The flexible hose 21 is then connected and delivers fluids to the production manifold 24. The production manifold 24 is connected to a flow line to transport the produced fluids.

Figure 3:
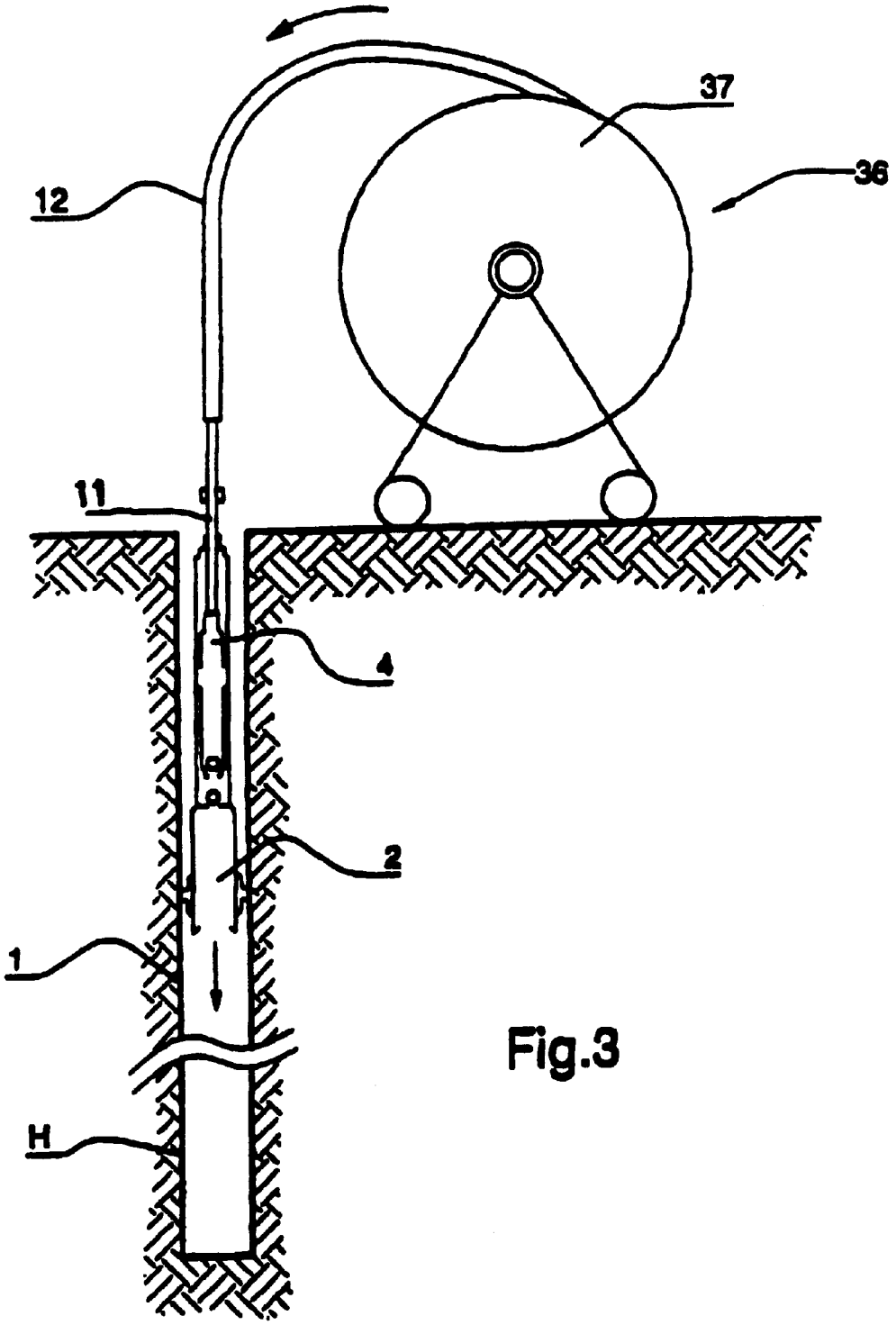
FIG. 3 is a simplified diagram of the installation method of the pumping assembly.

The continuous hollow tube or coiled tubing 12 according to the preferred embodiment of the present invention is preferably made of metal plate, preferably steel. U.S. Pat. No. 4,863,991 to Dubois describes a method and apparatus to make a long continuous tubes. It is to be understood that this type of coiled tubing 12 is provided coiled over a drum 37 on a reel 36 as shown in FIG. 3.

Preferably, the continuous hollow tube used presents an outer diameter between 1" and 2" inches with different grades and wall thicknesses as required by well pumping conditions. A preferred suitable size is a coiled tubing having a 1½" OD and a wall thickness of 0.134".

The installation method for the pumping assembly according to the present invention will now be described with reference to FIG. 3. FIG. 3 shows a drilled well borehole H secured with the casing 1. Preferably, a reel 36 having a drum 37 of coiled tubing or continuous hollow tube 12 is transported on a vehicle to the well location, close to the cased borehole H.

At the ground surface, a pump anchor 2 is coupled to the lower end of a subsurface pump 4. The free bottom end of the continuous hollow tubing 12 is connected to the hollow pull rod 11 of the subsurface pump 4. The continuous hollow tube 12 is then uncoiled, in a continuous motion from the drum 37 and is run into the cased borehole H through adequate guide means (not shown).

Eventually, and particularly in the case of slant or crooked holes, centralizers (not shown) can be attached to the continuous hollow tubing 12 at predetermined lengths and spacing.

Once a predetermined depth is reached with the continuous hollow tube 12 and its bottom pumping apparatus P, the uncoiling action is interrupted and the continuous hollow tube 12 is cut. The top end of the hollow tube 12 is held in place at the surface by means of retrievable slips (not shown). The retrievable pump anchor 2 is set in position in the casing 1 following the manufacturer's setting procedures.

Referring to FIG. 1, a hollow polished rod 14 is then connected to the free end of the continuous hollow tube 12 and at least one packing element 18 is installed between the hollow polished rod 14 and the wellhead W or the casing annulus.

The hollow polished rod 14 is suspended through a crosshead 16 so as to be operated by a "pumping unit" (not shown) that imparts an alternative or reciprocating axial movement to the hollow polished rod 14, the coiled tubing 12, the hollow pull rod 11 and the mobile plunger member 9.

As shown in FIG. 2, the hollow polished rod 14 is preferably connected to the flexible hose 21 through the quick hydraulic connector 20, the inverted "U" shaped tubing 22, and the quick hydraulic connector 23. The flexible hose 21 is then connected and delivers fluids to the production manifold 24 which is connected to a flow line to transport the produced fluids.

The described assembly allows the production fluids to pass up through the opening 5 in the pump anchor 2, through the pump plunger 9, the hollow pull rod 11, the coiled tubing 12, the hollow polished rod 14, the flexible hose assembly 21, into the production manifold 24 and the flowline.

The pumping assembly and pumping method of the present invention provides an efficient lifting method in oil wells ranging between 2,000 and 4,500 feet deep to pump approximately 180 barrels of fluid per day. Additionally, it has been found that the pumping assembly and pumping method of the present invention provides an efficient artificial lift method in oil wells of up to approximately 6,000 feet deep with an average production of approximately 350 barrels per day.

It is to be understood from the above description of the present invention that the present invention replaces the conventional production tubing and the string of sucker rods by a continuous hollow tube that performs both functions simultaneously. The continuous hollow tube results in weight savings, time and cost savings, and the elimination of numerous joint connections in conventional production tubing and sucker rods. The continuous hollow tube provides the operating axis of the pump as opposed to the string of sucker rods and also provides the conduit for bringing the produced fluids to the surface as opposed to the conventional production tubing.

The novel and original design of the present invention also allows for the drilling of new wells having a considerably smaller diameter borehole H than conventional wells which are usually in the range of approximately 8½". A well borehole of approximately 6⅛" diameter or even less is deemed appropriate for the present invention.

Likewise, the diameter of the casing 1 can also be reduced when drilling a new well in accordance with the present invention. The casing diameter used in conventional wells is typically between 5½" and 7" OD, while in the present invention can be approximately 3½" or less depending on well conditions.

The present invention has great significance and application. Bearing in mind that more than 50% of the new wells drilled throughout the world do not exceed depths of more than 5,000 feet, the cost reduction obtained though the use of the present invention becomes evident to those skilled in the art.

The foregoing disclosure and description of the invention are illustrative and explanatory thereof, and various changes in the details of the illustrated apparatus and construction and method of operation may be made without departing from the spirit of the invention.

What is claimed is:

1. In a well borehole drilled within a geological formation, an assembly for extracting production fluids from the well borehole to the ground surface comprising:

a casing lining the well borehole;

an upper housing connected to an upper end of said casing;

a subsurface pump having a stationary member and a reciprocating member, said stationary member anchored to said casing; and a hollow tube connected to said reciprocating member and extending substantially to the ground surface;

wherein reciprocating movement of said hollow tube produces production fluids through said hollow tube to the ground surface.

2. The assembly of claim 1, wherein said hollow tube is continuous coiled tubing.

3. The assembly of claim 1, further comprising:

a hollow rod connected to an upper end of said hollow tube;

a packing element installed in said upper housing or said casing to seal an annulus between said casing and said hollow rod.

4. The assembly of claim 1, wherein said hollow tube has a outer diameter of approximately one to two inches.

5. The assembly of claim 1, wherein said casing has a diameter of approximately 6⅛ inches or less.

6. The assembly of claim 1, wherein said stationary member of said subsurface pump is connected to a pump anchor and said pump anchor is retrievably secured to said casing.

7. An assembly for the extraction of fluid from a drilled well within a geological formation to the ground surface, the well having a borehole wall fixed by casing which is perforated at preselected depths, the assembly comprising:

a subsurface pump having a stationary member and a mobile member;

a pump anchor that secures said subsurface pump to the casing at a predetermined depth;

a hollow tube extending within the casing and having a first end connected to said mobile member of said subsurface pump; and a hollow rod having a first end connected to a second end of said hollow tube, wherein reciprocating movement of said hollow rod and said hollow tube produces fluids through said subsurface pump, hollow tube and hollow rod to the ground surface.

8. The assembly of claim 7, wherein said hollow rod is connected to an apparatus for providing reciprocating movement of said hollow rod and said hollow tube.

9. The assembly of claim 7, wherein said hollow tube is a continuous hollow to tube.

10. The assembly of claim 7, wherein said hollow tube has an outer diameter of approximately one to two inches.

11. The assembly of claim 7, wherein the casing has a diameter of approximately 6⅛ inches or less.

12. A method for extracting production fluids from a drilled well within a geological formation comprising the steps of:

lining a drilled borehole with casing;

mounting a wellhead to an upper end of the casing at a ground surface;

perforating the casing at a desired location to allow production fluids within a bore of the casing;

connecting a hollow tube to a mobile member of a subsurface pump;

anchoring the subsurface pump within the lower end of the casing; and providing reciprocating movement to the hollow tube to produce production fluids through the hollow tube.

13. The method of claim 12, wherein the hollow tube is continuous coiled tubing.

14. The method of claim 12, further comprising the step of lowering the subsurface pump into the casing with the hollow tube.

15. The method of claim 14, wherein the step of lowering the subsurface pump is accomplished from the ground surface by uncoiling and running the hollow tube in the borehole until reaching a predetermined depth.

16. The method of claim 15, wherein the hollow tube is continuous coiled tubing.

17. The method of claim 12, further comprising the steps of:

connecting a bottom end of a hollow rod to an upper end of the hollow tube;

installing a packing element in the wellhead or casing to seal an annulus between the casing and the hollow rod; and reciprocating the hollow rod to produce production fluids through the hollow tube.

18. The method of claim 17, further comprising the step of cutting the hollow tube prior to connecting the hollow rod to the hollow tube.

19. A method for extracting production fluids from a drilled well within a geological formation, the well having a borehole wall fixed by casing which is perforated at preselected depths, the method comprising the steps of:

connecting a hollow tube to a mobile member of a subsurface pump;

lowering the subsurface pump into the casing with the hollow tube;

anchoring the subsurface pump within the lower end of the casing; and providing reciprocating movement to the hollow tube to produce production fluids through the hollow tube.

20. The method of claim 19, wherein the step of lowering the subsurface pump is accomplished by uncoiling the hollow tube from a drum on the ground surface.

21. The method of claim 20, further comprising the steps of:

cutting the hollow tube after lowering the subsurface pump into the casing;

connecting a hollow rod to the upper end of the hollow tube; and reciprocating the hollow rod to produce production fluids through the hollow tube.

* * * * *

UNITED STATES PATENT AND TRADEMARK OFFICE

CERTIFICATE OF CORRECTION

PATENT NO. : 6,186,238 B1
DATED : February 13, 2001
INVENTOR(S) : Fernando Maria Solanet Tornquist It is certified that error appears in the above-identified patent and that said Letters Patent is hereby corrected as shown below:

Title page,
Left column, following "[22] Filed: August 18, 1999," insert
-- [30] Foreign Application Data
August 19, 1998 (AR) . . . 980104089. --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*